US006523612B2

(12) United States Patent
Reynolds

(10) Patent No.: US 6,523,612 B2
(45) Date of Patent: Feb. 25, 2003

(54) METHOD AND APPARATUS FOR CLEANING WELLBORE CASING

(75) Inventor: James Scott Reynolds, Houston, TX (US)

(73) Assignee: M-I L.L.C., Houston, TX (US)

( * ) Notice: Subject to any disclaimer, the term of this patent is extended or adjusted under 35 U.S.C. 154(b) by 9 days.

(21) Appl. No.: 09/824,319

(22) Filed: Apr. 2, 2001

(65) Prior Publication Data

US 2001/0042623 A1 Nov. 22, 2001

Related U.S. Application Data

(60) Provisional application No. 60/193,907, filed on Mar. 31, 2000.

(51) Int. Cl.[7] ..... E21B 37/04

(52) U.S. Cl. ..... 166/312; 166/170; 166/177.3; 166/177.4; 166/153

(58) Field of Search ..... 166/170, 171, 166/312, 153, 177.4, 177.3; 175/230, 231; 15/104.6

(56) References Cited

U.S. PATENT DOCUMENTS 1,994,072 A * 3/1935 Hardcastle
2,392,144 A * 1/1946 Hall
2,433,828 A * 1/1948 Cassell ..... 166/20
2,509,922 A * 5/1950 Hall
2,567,475 A * 9/1951 Hall
3,561,534 A * 2/1971 Dendy ..... 166/311
3,725,968 A * 4/1973 Knapp ..... 15/104.06
4,612,986 A * 9/1986 Fosdick, Jr. et al. ..... 166/171
4,896,720 A * 1/1990 DeRouen ..... 166/170
5,570,742 A * 11/1996 Reynolds ..... 166/173

* cited by examiner

*Primary Examiner*—David Bagnell
*Assistant Examiner*—Robert D Jones
(74) *Attorney, Agent, or Firm*—The Matthews Firm

(57) ABSTRACT

One or more brush bodies fabricated from an incompressible material, for example, from high density polyurethane, high density polyethylene, high density polypropylene, nylon, ORLON—synthetic forming polymers and copolymers of acrylic acid or its derivatives, high density plastics, phenolic resin-based materials hard rubber, wood, aluminum, or other easily drillable metals, are connected to, or integrally fabricated with one or more elastomeric, conventional cement plugs, and are pumped down within the interior of oilfield casing situated within an earth borehole, to minimize or eliminate the need to run a workstring of drillpipe and drill bit to clean out the interior of the string of casing.

24 Claims, 6 Drawing Sheets

METHOD AND APPARATUS FOR CLEANING WELLBORE CASING

RELATED APPLICATION

This application claims priority from U.S. Provisional Patent Application Serial No. 60/193,907, filed on Mar. 31, 2000.

BACKGROUND OF THE INVENTION

The present invention relates, generally, to method and apparatus for cleaning the interior of casing used in oil and gas wells, and specifically, to methods and apparatus for cleaning such casing before completing the well.

The prior art has generally accomplished the cleaning of the interior of downhole casing, before completing the well, by running a string of drill pipe having a brush thereon and a drill bit at the end of such drill pipe to traverse the casing and drill out any obstructions in the casing, for example, cement and other debris, and with the brush enables the casing to be cleaned out. Because the internal diameter of the casing is smaller than the diameter of the uncased well which had just been drilled prior to the casing being cemented in, the drill string used to drill the hole must first be laid down and then a second string of drill pipe of smaller diameter and having a smaller diameter drill bit, is used to run through the casing. Laying down one string of drill pipe and running a different string of drill pipe, sometimes referred to as a "work string", into the cased well to clean it out is very time consuming and is not cost effective.

In U.S. Pat. No. 4,896,720 to Mark W. DeRouen, there is disclosed an assembly which uses a brush attached to a top cement plug and a second brush connected between the upper cement plug and a lower cement plug used in the cementing operation. The assembly in intended to be pumped down the interior of the casing without using the work string of drill pipe and drill bit to clean out the interior of the casing. The brushes which are shown and described in U.S. Pat. No. 4,896,720 are fabricated from a nonrigid polyurethane foam and use a plurality of helical wraps of wire bristles disposed on the exterior surface of each such brush thereof, with the intent of the bristles contacting the interior surface of the casing. The purpose of the nonrigid polyurethane foam was an attempt to have the foam act as a spring-like device which would compress and maintain a constant contact with the interior wall of the casing. With such a device, however, the increasing pressures of the drilling fluid in the wellbore with depth causes the polyurethane foam to compress and pull the bristles away from the internal surface of the steel casing, thus resulting in the internal diameter of the casing not being thoroughly cleaned. Moreover, the brush body of the U.S. Pat. No. 4,896,720 requires an aluminum rod running along its length, from one end to the other, in an attempt to provide some degree of stability to the brush body, but which nonetheless fails to prevent the polyurethane foam from being compressed by the fluid pressure at the deeper depths encountered in a cased wellbore.

It should be appreciated that the combination brush and cement plug described in U.S. Pat. No. 4,896,720 is not as easily drillable as might be desired. Because the body of the polyurethane foam brushes, disclosed in the '720 patent, are resilient, as a drill bit commences to drill out such brushes, the brushes will sometimes begin to rotate with the drill bit and delay the drilling out process by a considerable period of time. This type of problem occurs with attempting to drill out the resilient cement plugs themselves and is only worsened by adding in one or more brushes having resilient bodies with the identical problem.

It is therefore the primary object of the present invention to provide a new and improved method and apparatus for cleaning the interior of well casing, in which the bristles of the one or more brushes in the apparatus maintain a constant contact with the interior of the casing down to the desired depth to which the apparatus is pumped down.

As noted in U.S. Pat. No. 4,896,720, specifically in its Col. 3, lines 48–52, the density range for the nonrigid polyurethane foam brush body is preferably between eight and ten pounds per cubic foot. In sharp contrast, to avoid the polyurethane brush body being a compressible foam, the density selected for the present invention must be greater than ten pounds per cubic foot, preferably at least twelve pounds per cubic foot, if using polyurethane as the brush body.

It is also another object of the present invention to provide new and improved methods and apparatus for cleaning the interior of wellbore casing, in which the apparatus is more easily drilled out than with the methods and apparatus known in the prior art.

These and other objects, features, and advantages of the present invention will be better understood after reviewing the appended drawings and the following detailed specification.

DETAILED DESCRIPTION OF THE PREFERRED EMBODIMENTS OF THE PRESENT INVENTION

Figure 1:
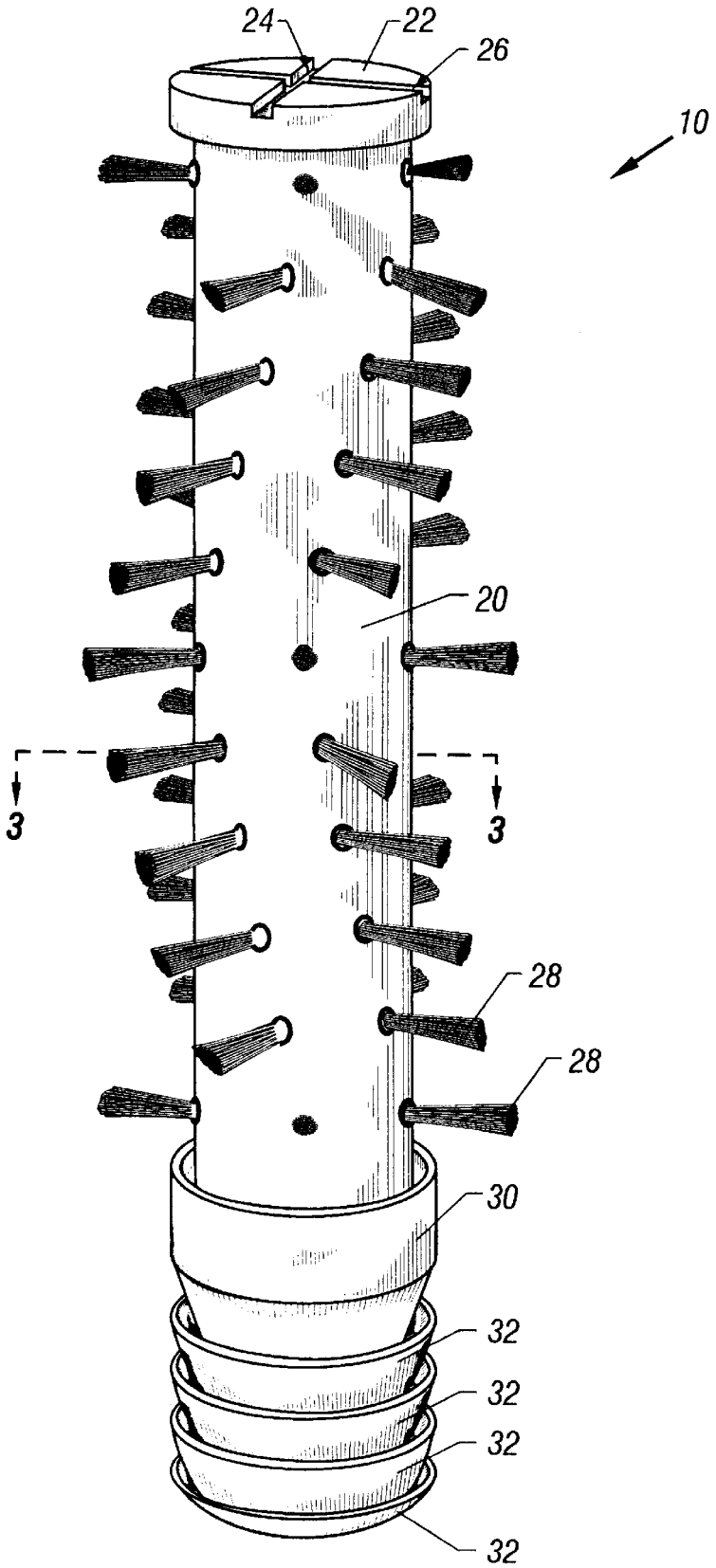
FIG. 1 is an elevated, isometric view of a combination brush and cement plug according to the present invention.

Referring now to FIG. 1, there is illustrated a combination brush and cement plug, together identified by the numeral 10, which includes the brush body 20 and the cement plug body 30. The brush body 20 has at its upper end, a cap 22 which is tack- welded to the brush body 20 and which has a pair of indentations 24 and 26 in perpendicular relationship to each other and which provides a place for the drill bit (not illustrated) to bite into the cap 22 when it is time to drill out the assembly 10. A plurality of holes are drilled into the wall of the brush body 20 of a given diameter. A plurality of brushes 28 which typically are fabricated from a plurality of steel wires, or the like and are each welded or glued into a plurality of caps, respectively, which are slightly smaller in diameter than the holes of a given diameter which are drilled into the body 20. After the brushes are in place within the caps, the caps are pressed into the holes in the brush body 20, typically by hand, to form a friction fit between the caps and the individual holes in the sidewall of the brush body 20.

Figure 3:
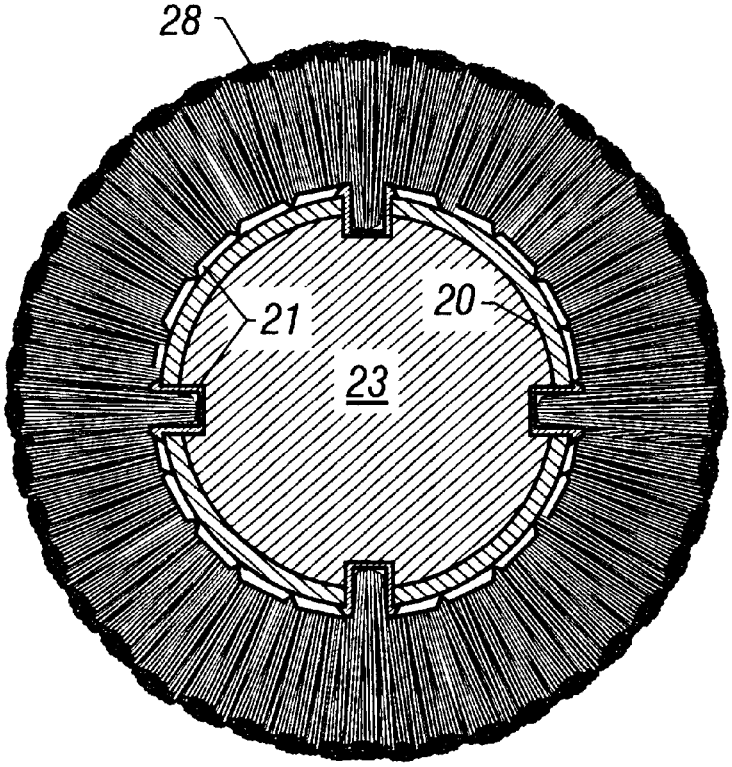
FIG. 3 is a cross sectional view of the brush illustrated in FIG. 1 according to the present invention, taken along the section line 3—3.

Referring now to FIG. 3, there is illustrated a cross sectional view taken along the section line 3—3 of FIG. 1, and illustrates how the cups are pressed into the sidewall of the brush body 20. After the cups 21, each having a brush bundle 28 contained therein, are inserted into the holes through the sidewall of the body 20. The interior 23 of the body 20 is filled with liquid urethane, which will then harden and hold each of the cups 21 in place within the body 20.

Figure 8:
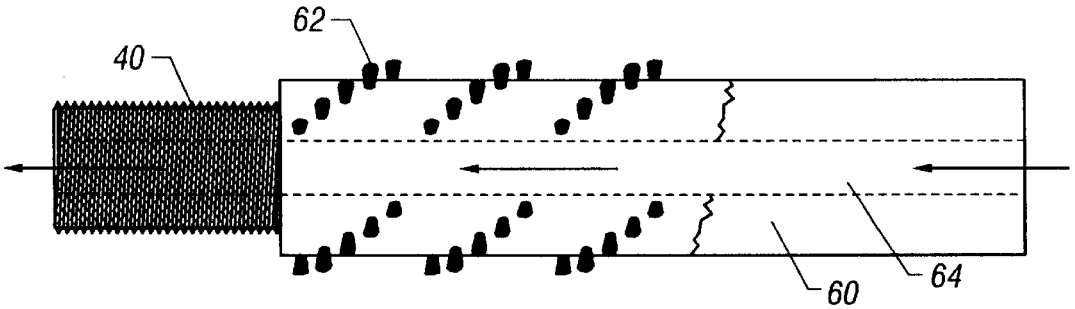
FIG. 8 illustrates graphically the manner in which the interior of one of the brush assemblies in accordance with the present invention provides a path for fluid to pass therethrough.

The assembly 10 also includes a conventional, elastomeric cement cup 30 which has a plurality of circumferential flange portions 32, typically made of a relatively hard but deformable rubber or rubber like material and includes a metal, cylindrical core piece (not illustrated) which is provided with a female thread (not illustrated) for coupling the cement plug 30 to the brush 20 which has a male thread 40 as illustrated in FIG. 8.

Figure 2:
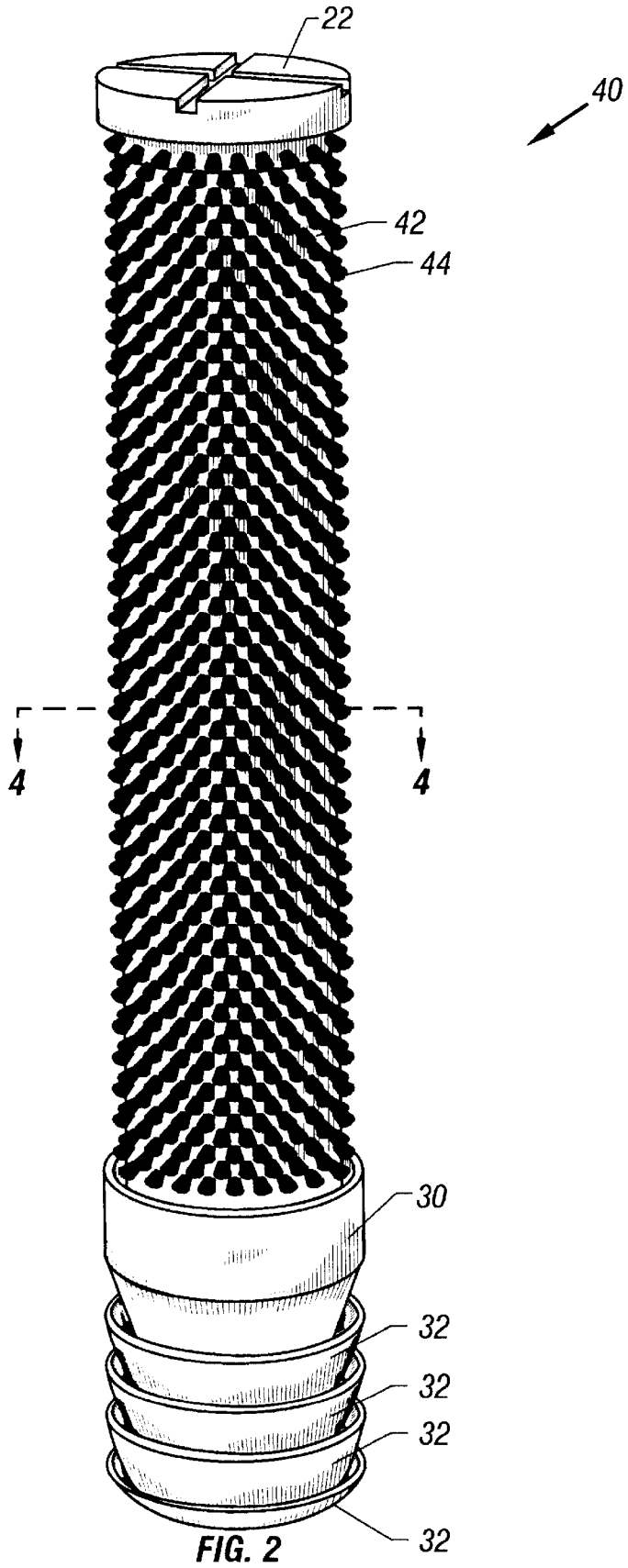
FIG. 2 is an elevated, isometric view of an alternative embodiment of the combination brush and cement plug according to the present invention.
Figure 4:
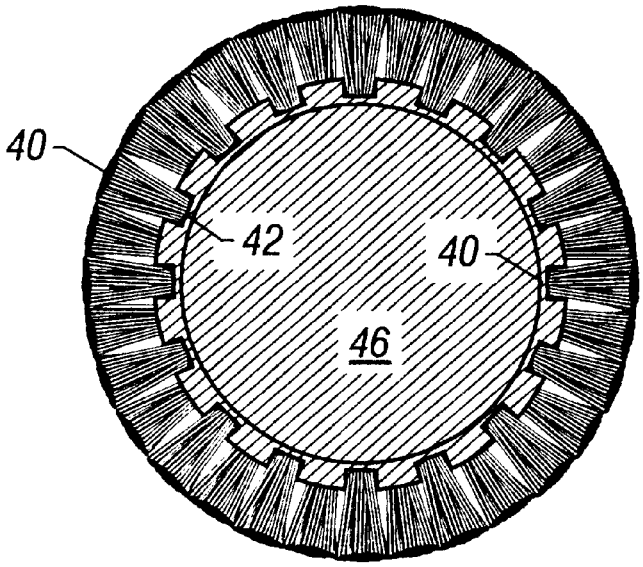
FIG. 4 is a cross sectional view taken along the line section 4—4 of the embodiment in FIG. 2.

Referring now to FIG. 2, there is illustrated an alternative embodiment of the brush portion of the combination brush and cement plug in accordance with the present invention. The assembly 40 includes a conventional cement plug 30 having the flange portions 32 as discussed above with respect to FIG. 1. The assembly 40 also includes a brush body 42 and a plurality of brushes 44. The brushes 44, as illustrated in FIG. 2, preferably are each forced into a plurality of holes 42 formed in the brush body 40, as illustrated in the cross section in FIG. 4 along the sectional line 4—4 of FIG. 2. The center portion 46 in FIG. 4 can either be left whole, solid, or filled with urethane or the like if not left as a solid part of the brush body 40.

Figure 5:
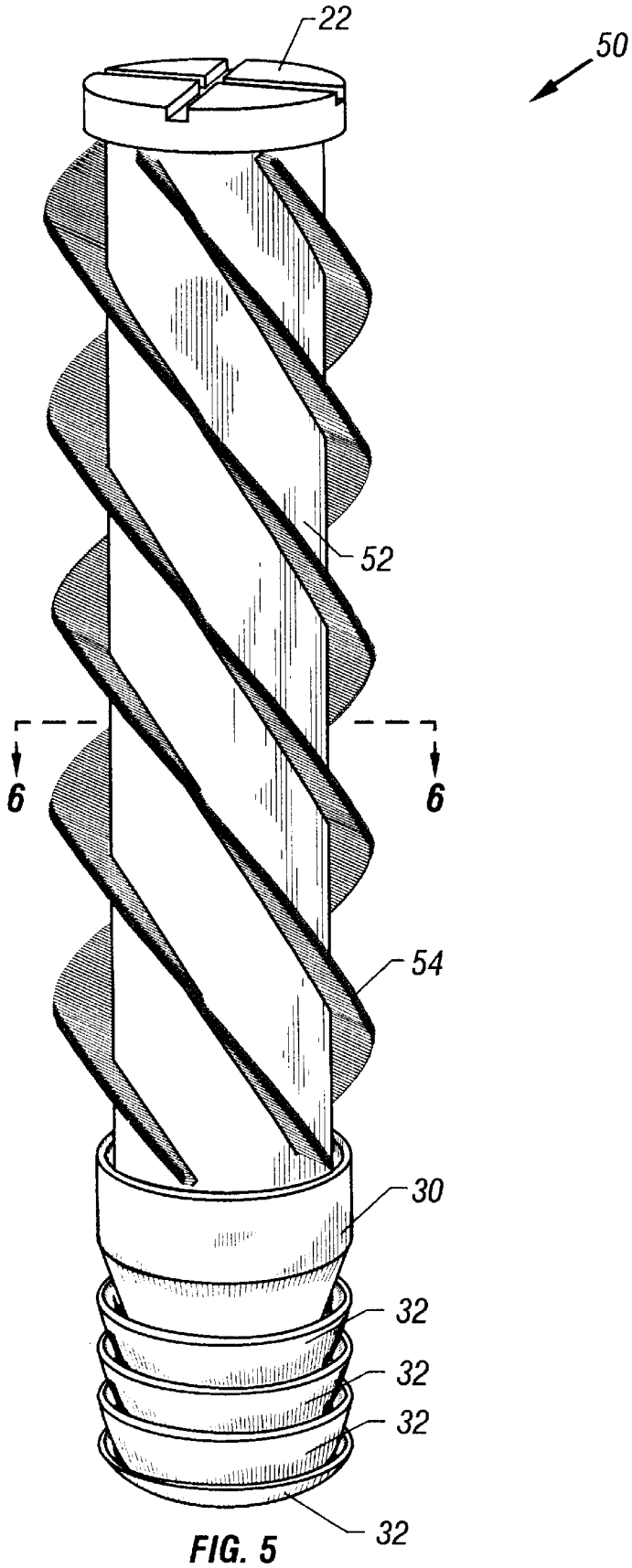
FIG. 5 is an elevated, isometric view of an alternative embodiment of the present invention.

FIG. 5 illustrates yet another embodiment of the combination brush and cement plug assembly 50. The assembly 50 includes the tack-welded cap 22 discussed above with respect to FIGS. 1 and 2 and also includes, at its lower end, a conventional elastomeric cement cup 30 having a plurality of elastomeric flanges 32.

Figure 6:
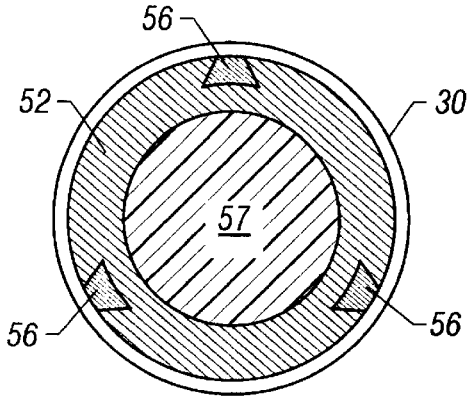
FIG. 6 is a cross sectional view taken along the section lines 6—6 of FIG. 5.
Figure 7:
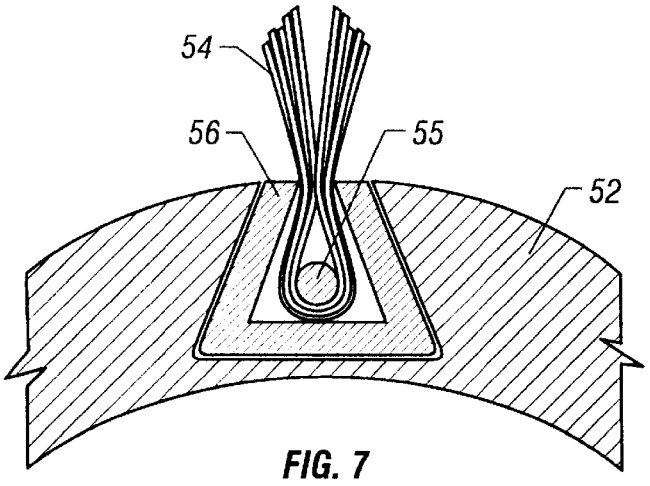
FIG. 7 is a cross sectional view of the embodiment of FIG. 5, illustrating a strip brush in assembly.

The assembly 50 includes a brush body 52 and has a conventional strip brush 54 which is wrapped around the brush body 52 and which is attached to the brush body as is illustrated in FIGS. 6 and 7. FIG. 7 illustrates a side view, in cross section, of the manner in which the strip brush 54 is connected to the body 52. Each of the brushes 54 is connected around a rod like member 55 and that subassembly is placed within the truncated pyramid type opening 56 within the body 52. Because the truncated pyramid type body is smaller at its top surface than at its lower, the strip brush is loaded from the side in a manner well known in the art of using strip brushes.

FIG. 6 illustrates the embodiment of FIG. 5, taken in cross section along the section line 6—6, in which the body 52 has embedded therein the three truncated pyramid pockets 56 but without showing the strip brush itself therein. Because the section view shown in FIG. 6 does not include the strip brush itself, there is also shown the top surface of the elastomeric cement plug 30. It should be appreciated that the center portion of the cross sectional view illustrated in FIG. 6 could be left solid, hollow, or filled with urethane or the like.

Referring now to FIG. 8, there is illustrated an embodiment of the present invention in which a brush plug 60 having a plurality of brushes 62 and a male threaded end portion 40 for connecting to the elastomeric cement plug, has a central passage 64 which can be used with the present invention if it is desired to allow fluids to pass therethrough. Although the passageway 64 is shown as having no particular profile other than having parallel sidewalls as in a straight tube, the passageway 64 can have various profiles to enable darts, balls, or the like to pass therethrough and to activate various downhole tool assemblies as is well known in this art.

It should be appreciated that the brush bodies 20 of FIG. 1, 42 of FIG. 2, 52 of FIG. 5, and 60 of FIG. 8 preferably are fabricated from high density plastics such as high density polyurethane, i.e., polyurethane having a density of greater than ten pounds per cubic foot, and preferably at least twelve pounds per cubic foot, high density polyethylene and the like. Moreover, in the preferred embodiment, the brush body should be rigid and more easily drillable than the material which is nonrigid. However, and perhaps of more importance, the brush body should not be compressible. If compressible, the brushes themselves will tend to pull away from the casing wall as above discussed with respect to the use of polyurethane foam, having a density in the eight to ten pounds per cubic foot range. By being incompressible, the present invention also contemplates that the pressed body can be made out of hard rubber with the brushes embedded within the hard rubber and as held within such rubber by any means which might be used, for example, by using urethane within the interior of the brush body to hold the brushes in place as is discussed above with respect to the embodiment of FIG. 1.

The invention therefore contemplates that the brush body can be fabricated from any incompressible material such as hard plastic or hard rubber, but in the most preferred embodiment, contemplates that the brush body be manufactured from a rigid material such as hard plastic.

Figure 9:
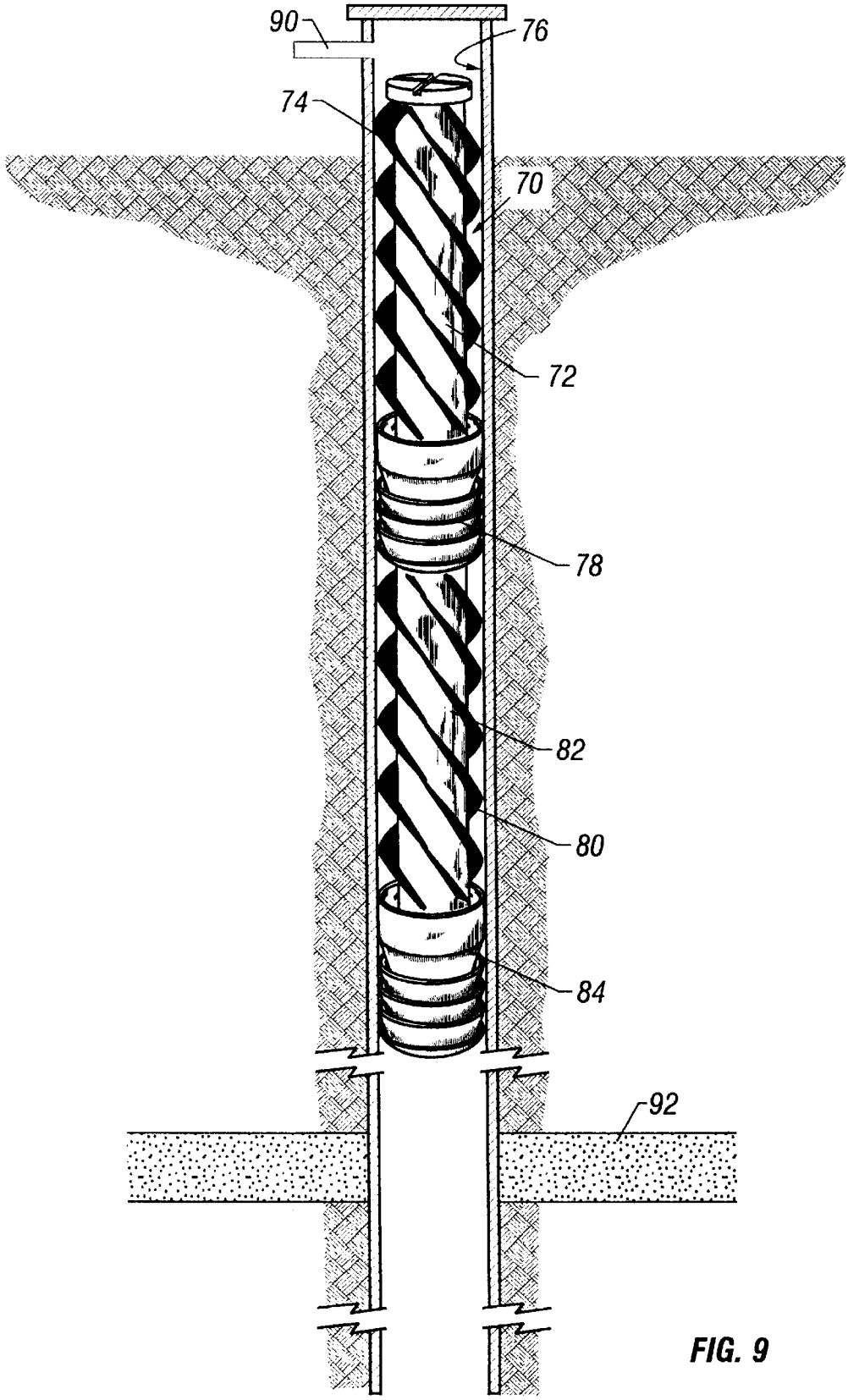
FIG. 9 is a schematic illustration of the assembly according to the present invention being pumped through a casing string.

Referring now to FIG. 9, there is illustrated, schematically, an assembly in accordance with the present invention in which a brush 70 having an incompressible body 72 and a row of brushes 74 which are sized to be in contact with the internal diameter of the steel casing 76, is threadably attached to a first elastomeric, conventional cement plug 78. The cement plug 78 is also threadably attached to a second brush 80 which also has a body fabricated from an incompressible material 82. The second brush is also threadable connected at its lower end to a second conventional, elastomeric cement plug 84. If desired, a third brush (not illustrated) which also has a body of an incompressible material is threadably attached to the lower end of the cement plug 84, to enable one of the brushes to run ahead of the cement plug 84. In addition, the brushes illustrated in FIG. 9, as well as the elastomeric cement plugs, can have fluid bypasses as illustrated in FIG. 8 if desired.

In operation, fluid is pumped into the upper end of the steel casing 76 through the conduit 90 to pump the assembly down through the interior of the casing. Assuming that the casing 76 is a socalled "long string", i.e., wherein the internal diameter of the casing remains the same along its length from the earth's surface down to TD, as fluid is pumped in through the conduit 90, the assembly consisting of the two brushes and the two cement plugs are pumped down to a zone of interest. If it is desired to complete the well within the pay zone 92, the brushes and the cement plugs are pumped down beneath the pay zone 92 to enable a wire line perforation system, well known in the art, to be run behind the pump down of the brushes and cement plugs to the area below the pay zone 92 and to thus enable the casing 76 to be used in perforating the casing adjacent to pay zone 92, all of which is well known in this art.

It is contemplated that the combination brush and cement plug assembly, according to the present invention, can be used in three ways:

1) When running long strings of production casing (one size of casing from the other surface to TD), the brush plug is attached to the top cementing plug and pumped down ahead of the completion fluid or sea water, as the case may be. Pumping the brush plug behind the cement and ahead of the completion fluid or sea water, there is eliminated a need for a scraper run in "natural completions". Once the cement plugs have bumped down, the wire line will be rigged up to run a gauge ring. The gauge ring will determine if the packer will get all the way to the bottom of the casing without hanging up. If the wire line run had no hang ups, the need for picking up a work string to run a drill pipe to clean the cement sheath has been eliminated. This will save a day of rig time while picking up pipe and the cost to rent the work string. The brush plug must itself be made of a drillable material in case the cement plugs do not bump and are sitting high in the casing. A work string with a drill bit will need to be picked up to drill out the plugs, thus the need for an easy drillable brush cement plug combination.
2) The combination brush cement plug will also be designed, in accordance with the present invention, with a through bore having a profile machined in to accept one or more darts and one or more balls to launch the cement plug from a sub sea launcher.
3) With the combination brush cement plug having a bore to circulate through the cement plug the assembly can be adapted to run multiple brush plugs when cementing casings in the ground. The cement plugs will be run ahead of the cement to help remove scale, mud and any debris that might contaminate the cement bonding to the outside diameter of steel casing in the open hole.

As stated hereinbefore, the body of the brush is preferably made from aluminum, high density polypropylene, nylon, high density urethane, high density plastic or an ORLON—synthetic fiber-forming polymers and copolymers of acrylic acid or its derivatives, hard plastic, phenolic resin-based materials, rubber, carbon fiber, high density urethane, high density polyurethane, high density polyethylene or even from wood, and combinations thereof. The main reason for running the combination brush cement plug is to eliminate the need for a work string and scraper runs in natural completions, i.e., when pressures are low or in the normal range and the completion equipment can be run on a wire line. The other reason for running the brush cement plug combination in accordance with the present invention is to minimize wellbore clean up time and to minimize clean up chemicals, therefore minimizing the waste which would otherwise be generated.

It is imperative that the brushes used in the brush cement plug combination according to the present invention be made from a incompressible material, preferably from rigid material, to allow the brushes to be in constant contact with the interior of the steel casing while the assembly is being pumped down to the depth of interest.

What is claimed is:

1. An assembly for pumping down within the interior of a string of oilfield casing having a given internal diameter, to clean out the debris located within such string of casing, comprising:

a brush body comprised of an incompressible material;

one or more brushes located on, near, or within the external surface of said brush body, said one or more brushes being sized to contact the internal surface of said casing whenever said assembly is being pumped down the interior of said string of oilfield casing; and an elastomeric cement plug connected to said brush body, said elastomeric cement plug being sized to swab the internal surface of said casing whenever said assembly is being pumped down the interior of said string of oilfield casing.

2. The assembly according to claim 1, wherein said brush body consists of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, hard rubber, aluminum, and wood, and combinations thereof.

3. The assembly according to claim 1, wherein said brush body comprises polyurethane having a density of greater than ten pounds per cubic foot.

4. The assembly according to claim 1, wherein said brush body comprises polyurethane having a density of at least twelve pounds per cubic foot.

5. A method of cleaning the internal surface of a string of oilfield casing having a given internal diameter at least partially cemented in an earth borehole, comprising:

pumping an assembly within the interior of said casing down to a depth in said earth borehole, said assembly comprising:

a brush body comprised of an incompressible material;

one or more brushes located on, near or within the external surface of said brush body, said one or more brushes being sized to contact the internal surface of said casing whenever said assembly is being pumped down the interior of said string of oilfield casing; and an elastomeric cement plug connected to said brush body, said elastomeric cement plug being sized to swab the internal surface of said casing whenever said assembly is being pumped down the interior of said string of oilfield casing.

6. The method according to claim 5, wherein said brush body consists of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, hard rubber, aluminum, and wood, and combinations thereof.

7. The method according to claim 5, wherein said brush body comprises polyurethane having a density of greater than ten pounds per cubic foot.

8. The method according to claim 5, wherein said brush body comprises polyurethane having a density of at least twelve pounds per cubic foot.

9. An assembly for pumping down within the interior of a string of oilfield casing having a given internal diameter, to clean out the debris located within such string of casing, comprising:

a brush body comprised of a rigid material;

one or more brushes located on, near, or within the external surface of said brush body, said one or more brushes being sized to contact the internal surface of said casing whenever said assembly is being pumped down the interior of said string of oilfield casing; and an elastomeric cement plug connected to said brush body, said elastomeric cement plug being sized to swab the internal surface of said casing whenever said assembly is being pumped down the interior of said string of oilfield casing.

10. The assembly according to claim 9, wherein said brush body consisted of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, aluminum, and wood, and combinations thereof.

11. The assembly according to claim 9, wherein said brush body comprises polyurethane having a density of greater than ten pounds per cubic foot.

12. The assembly according to claim 9, wherein said brush body comprises polyurethane having a density of at least twelve pounds per cubic foot.

13. A method of cleaning the internal surface of a string of oilfield casing having a given internal diameter at least partially cemented in an earth borehole, comprising:

pumping an assembly within the interior of said casing down to a predetermined depth in said earth borehole, said assembly comprising:

a brush body comprised of a rigid material;

one or more brushes located on, near or within the external surface of said brush body, said one or more brushes being sized to contact the internal surface of said casing whenever said assembly is being pumped down the interior of said string of oilfield casing; and an elastomeric cement plug connected to said brush body, said elastomeric cement plug being sized to swab the internal surface of said casing whenever said assembly is being pumped down the interior of said string of oilfield casing.

14. The assembly according to claim 13, wherein said brush body consists of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, aluminum, and wood, and combinations thereof.

15. The assembly according to claim 13, wherein said brush body comprises polyurethane having a density of greater than ten pounds per cubic foot.

16. The assembly according to claim 13, wherein said brush body comprises polyurethane having a density of at least twelve pounds per cubic foot.

17. An assembly for pumping down within the interior of a string of oilfield casing having a given internal diameter, to clean out the debris located within such string of casing, comprising:

at least one brush body comprised of an incompressible material;

one or more brushes located on, near, or within the external surface of each of said at least one brush body, said one or more brushes being sized to contact the internal surface of said casing whenever said assembly is being pumped down the interior of said string of oilfield casing; and at least one elastomeric cement plug connected, respectively, to each of said at least one brush body, said elastomeric cement plug or plugs being sized to swab the internal surface of said casing whenever said assembly is being pumped down the interior of said string of oilfield casing.

18. The assembly according to claim 17, wherein said brush body or bodies consists of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, hard rubber, aluminum, and wood, and combinations thereof.

19. The assembly according to claim 17, wherein said brush body or bodies each comprises polyurethane having a density of greater than ten pounds per cubic foot.

20. The assembly according to claim 17, wherein said brush body or bodies each comprises polyurethane having a density of at least twelve pounds per cubic foot.

21. An assembly for pumping down within the interior of a string of oilfield casing having a given internal diameter, to clean out the debris located within such string of casing, comprising:

at least one brush body comprised of a rigid material;

one or more brushes located on, near, or within the external surface of each of said at least one brush body, said one or more brushes being sized to contact the internal surface of said casing whenever said assembly is being pumped down the interior of said string of oilfield casing; and at least one elastomeric cement plug connected, respectively, to each of said at least one brush body, said elastomeric cement plug or plugs being sized to swab the internal surface of said casing whenever said assembly is being pumped down the interior of said string of oilfield casing.

22. The assembly according to claim 21, wherein said brush body or bodies each consists of a material selected from the class of high density polyurethane, high density polyethylene, high density polypropylene, nylon, synthetic fiber-forming polymers and copolymers of acrylic acid or its derivatives, carbon fiber and high density urethane, high density plastic, phenolic resin-based materials, aluminum, and wood, and combinations thereof.

23. The assembly according to claim 21, wherein said brush body or bodies each comprises polyurethane having a density of greater than ten pounds per cubic foot.

24. The assembly according to claim 21, wherein said brush body or bodies each comprises polyurethane having a density of at least twelve pounds per cubic foot.

* * * * *